United States Patent [19]

Chessin

[11] Patent Number: 4,472,249

[45] Date of Patent: Sep. 18, 1984

[54] BRIGHT CHROMIUM PLATING BATHS AND PROCESS

[75] Inventor: Hyman Chessin, Brick, N.J.

[73] Assignee: M&T Chemicals Inc., Woodbridge, N.J.

[21] Appl. No.: 295,430

[22] Filed: Aug. 24, 1981

[51] Int. Cl.[3] ..... C25D 3/10

[52] U.S. Cl. ..... 204/51

[58] Field of Search ..... 204/51, 105 R

[56] References Cited

U.S. PATENT DOCUMENTS

| | | | |
|---|---|---|---|
| 3,248,310 | 4/1966 | Schaer | 204/51 |
| 3,654,101 | 4/1972 | Aoun | 204/51 |
| 3,706,643 | 12/1972 | Huba | 204/51 |
| 3,788,957 | 1/1974 | Christie et al. | 204/51 |

*Primary Examiner*—G. L. Kaplan

*Attorney, Agent, or Firm*—S. A. Marcus; J. Matalon; S. H. Parker

[57] ABSTRACT

The invention provides a hexavalent chromium plating bath containing chromic acid, an iodine releasing compound and/or a bromine releasing compound such as iodate, periodate, bromate or perbromate, and a carboxylate which is stable in the bath. Exemplary stable carboxylates include acetic acid, propionic acid, chloroacetic acid, trichloroacetic acid, succinic acid, sulfoacetic acid, benzoic acid, picolinic acid, and nicotinic acid. Bright chromium deposits can be produced with these baths at high current efficiencies employing high temperatures with substantially no low current density etch.

17 Claims, No Drawings

BRIGHT CHROMIUM PLATING BATHS AND PROCESS

BACKGROUND OF THE INVENTION

This invention is concerned with the electrodeposition of bright chromium on basis metals from hexavalent chromium plating baths at high current efficiencies.

In the past, ordinary hexavalent chromium plating baths containing chromic acid and a catalyst such as sulfate ion generally permit the deposit of chromium metal on the basis metal at cathode efficiencies of between 12% and 16% at temperatures between about 125° F. and 155° F. (52° C. to 68° C.) and at current densities of from about 30 to about 50 a.s.d. Mixed catalyst chromic acid plating baths containing both sulfate and fluoride ions generally allow the plating of chromium at higher rates and at cathode efficiencies of between 22% and 26%. Fluoride ion however, causes etching of ferrous based metals when the cathode current density is too low to deposit chromium metal, usually below about 5 a.s.d. in fluoride containing baths. This phenomenon is called low current density etch.

Generally, the properties of a chromium deposit vary with certain principal deposition factors, particularly temperature and current density. Useful deposits are associated with the bright or semi-bright range. In an ordinary sulfate-catalyzed bath at 30° C., bright deposits are obtained from about 2 a.s.d. to 8 a.s.d.; at 40° C. they are obtained from about 3 a.s.d. to 18 a.s.d. and at 50° C., from about 6 a.s.d. to 28 a.s.d. (Ref.: Chromium Plating, R. Weiner & A. Walmsley, Finishing Publications Ltd., Teddington, Middlesex, England, 1980 page 52). Milky deposits are produced below the low current densities for each temperature, i.e. below 2 a.s.d. at 30° C., 3 a.s.d. at 40° C. and 6 a.s.d. at 50° C., while frosty deposits are obtained above the higher current densities for each temperature, i.e. above 8 a.s.d. at 30° C., 18 a.s.d. at 40° C. and 28 a.s.d. at 50° C. Abrasive wear resistance which is associated with hardness is at a maximum within the frosty bright region of the bright range. Corrosion resistance, another important property, is at a maximum in the milky region of the bright range. Bright deposits are achieved between the frosty and milky regions and are generally characterized by having intermediate abrasive wear resistance and corrosion resistance.

Chromium plating baths have been recently developed by Perakh et al (see U.S. Pat. No. 4,234,396, for example) which contain from 100 g to 1600 g chromium trioxide per liter and, based on the chromium trioxide content, 0.3 to 15 wt. percent chlorine or chloride ions and/or 0.3 to 10 wt. percent iodine and/or iodide ions. Perakh baths containing chlorine or chloride ions alone generally yield dull to semibright deposits, the semi-bright deposits occurring at low temperatures (19° C.). When iodine or iodide ions are used alone in such baths, semi-bright deposits are still attained at low temperatures (<24° C.). In the case of Perakh baths containing both halogen species, bright deposits are achieved but only at bath temperatures not exceeding about 50° C.

The present invention, on the other hand, provides a chromium plating bath containing additives which produce bright chromium deposits at current efficiencies of over 30%, more often 40–50%, over a wide range of current densities and with no low current density etch. Moroever, unlike the Perakh-type baths, bright deposits may be achieved at high temperatures (i.e. greater than 50° C.). The high bath temperatures allow bright plating at wider ranges of current densities than at lower temperatures and also promote adherence of the deposit.

SUMMARY OF THE INVENTION

The additives for the hexavalent chromium plating baths of this invention comprise an iodine and/or bromine releasing compound and a stable carboxylate which includes stable carboxylic acids, salts and anhydrides thereof. Moreover, bright deposits can be obtained with the baths of this invention at chromic acid concentrations as low as 200 g/l to 400 g/l (as $CrO_3$).

A method for plating bright chromium on basis metals at temperatures greater than about room temperature (25° C.) and preferably greater than 40° C. which allows the broadening of the range of useful current densities is also provided employing the hexavalent chromium plating baths formed with the above additives.

DETAILED DESCRIPTION OF THE PREFERRED EMBODIMENTS

Hexavalent chromium plating baths useful in this invention contain a source of hexavalent chromium, particularly chromium trioxide ($CrO_3$), the anhydride of chromic acid, and may be either uncatalyzed or catalyzed with such known catalyst ions as sulfate, borate, fluoride and complex fluoride, chloride and chlorate.

The iodine or bromine-releasing compounds are iodine or bromine-containing compounds which are capable of releasing iodine or bromine species in the bath in the form of radicals such as iodine, iodide, iodate, periodate, bromine, bromide, bromate, perbromate and the like as well as mixtures thereof. It is believed that non-oxygen containing iodine or bromine species such as iodine, iodide, bromine and bromide are oxidized by the oxidizing bath media to iodo-oxy ions or bromo-oxy ions such as iodate, bromate, periodate and perbromate ions. The iodine or bromine-releasing compounds include elemental iodine and bromine, hydroiodic acid, hydrobromic acid and their salts such as sodium or potassium iodide or bromide, iodic acid, bromic acid and their salts such as potassium or sodium iodate or bromate, periodic acid perbromic acid and their salts such as sodium or potassium periodate and perbromate, organo iodides and bromides; and hydrolyzable metal polyodides and polybromides such as $SnBr_4$, $TiI_4$ and $SrBr_4$.

The carboxylates of this invention as present in the bath are carboxylic acids or salts thereof which are bath soluble and stable in the electroplating bath both before and during electrodeposition. By "stable" herein is meant that the carboxylates do not appreciably change their chemical form in the bath, that is, they do not appreciably oxidize, decarboxylate, disproportionate, or react with any components of the bath before or during electroplating. Such carboxylates are added to the bath as stable unsubstituted and substituted mono and polycarboxylic acids, salts or anhydrides thereof. The monocarboxylic acids preferably contain from about 2 to about 6 carbon atoms and the polycarboxylic acids, preferably dicarboxylic acids, preferably contain from about 4 to about 8 carbon atoms. Substituents for these stable mono and polycarboxylic acids are preferably halogen, sulfonate, aromatic and heterocyclic N-containing radicals. Classes of stable substituted carboxylic acids include α-halo monocarboxylic acids, α-sulfo monocarboxylic acids, aromatic monocarboxylic acids, aromatic dicarboxylic acids and heterocyclic N-containing monocarboxylic acids. Exemplary stable carboxylates include acetic acid, propionic acid, monochloroacetic acid, trichloroacetic acid, succinic acid, sulfoacetic acid, benzoic acid, phthalic acid, nicotinic acid, and picolinic acid. Carboxylic acids which are unstable and therefore unsatisfactory for the baths of this invention include formic acid, oxalic acid, hydroxy containing carboxylic acids, α-carboxy carboxylic acids, and amino acids. It has been demonstrated that amino acids will react with hexavalent chromium and that this reaction is accelerated at elevated temperatures. Boric acid may be optionally employed together with a stable carboxylate. For example, the combination of trichloroacetic acid and boric acid in a chromic acid bath produces highly bright chromium depposits at 60° C.

Generally the amount of iodine or bromine-releasing compound should be added to the bath to yield concentrations of between about 0.5 g/l and 16 g/l and preferably from 1 g/l to 8 g/l, calculated as iodine or bromine to obtain optimum brightness of the chromium deposit.

At concentrations below 0.5 g/l there is insufficient compound present to produce a bright deposit. At greater than 16 g/l the deposit begins to deteriorate.

The concentration of carboxylate can be between about 1 g/l up to the limits of solubility and preferably between 5 g/l and 100 g/l in most cases.

The optimum concentration of chromic acid is about 800 g/l in most cases. However, highly satisfactory deposits can be obtained at concentrations of 400 g/l. The effective concentration of chromic acid will vary according to the type of stable carboxylate employed. For example, using monochloroacetic acid bright chromium deposits are produced at a concentration of chromic acid of 400 g/l. In the case of acetic acid, however, the concentration of chromic acid must be increased beyond 400 g/l to achieve bright deposits. In some cases the concentration of chromic acid, as $CrO_3$, can be as low as 200 g/l. The upper limit is about 1600 g/l. At $CrO_3$ concentrations below about 200 g/l and above about 1600 g/l the chromium deposits begin to deteriorate.

The chromium plating baths of this invention are useful in both hard and decorative chrome plating operations. Hard chromium plating operations are usually employed for the deposition of bright or semi-bright chromium on ferrous or aluminum metal articles of relatively simple shape such as piston rings, cylinders, shock rods, McPherson struts and hydraulic shafts. The thickness of the deposit ranges from about 1 micron to 200 microns or more. Generally, hard chromium plating can be made to occur rapidly to reduce plating time. Hard chromium plating baths generally contain a ratio of chromic acid concentration to catalyst concentration of from about 75/1 to 100/1 and are operated between about 55°-60° C. at current densities between about 2 and 60 a.s.d.

Decorative plating is generally employed to deposit bright or semi-bright chromium onto complex metal articles having a bright nickel electrodeposit thereon. Such articles include automotive bumpers, wheel covers, electrical appliances, and trim for metal, plastic or ceramic structures. The thickness of the chromium deposit ranges from 0.1-2 microns. Decorative chromium plating baths are usually operated at a ratio of chromic acid concentration to catalyst concentration of from about 100/1 to about 120/1 at temperatures below about 50° C. and at current densities between about 3 and 18 a.s.d.

The advantages of the plating baths of this invention are significant.

Firstly, the current efficiencies during electroplating are greater than 30% and frequently as high as 45% to 50%. This represents a marked improvement over standard catalyst and mixed catalyst plating baths which achieve current efficiencies of no greater than about 26%.

Secondly, the baths of this invention, can be operated at temperatures greater than 40° C. and preferably 50° C. to 60° C. to deposit bright chromium having good wear and corrosion resistance. This represents a significant improvement over the Perakh-type baths, previously discussed, which only produce bright chromium deposits up to a maximum of 50° C. and then only when both chloride and iodide are present. The operation of the baths of this invention at temperatures above about 50° C. contributes to the attainment of high current efficiencies and obviates the necessity for external cooling media to control temperatures. In practice the baths of this invention need only be heated initially; thereafter the exotherm developed by the electrochemical reaction taking place in the bath is sufficient to maintain the high temperatures. Thus the need for expensive chilling is obviated. Moreover, high temperatures of electrodeposition enhance adhesion of the deposit.

Thirdly, the baths of this invention do not cause low current density etch of the ferrous based metals as in the case of mixed catalyst baths containing, inter alia, fluoride ion.

In order to more fully describe the present invention, the following Examples are presented.

EXAMPLE 1

This Example demonstrates the deposition of bright chromium deposits from a chromic acid bath according to the invention containing an iodine releasing compound ($KIO_3$) and acetic acid at temperatures between 40° C. and 60° C.

A steel mandrel was chromium plated from a chromic acid bath containing the following additives:

$CrO_3$—830.00 g/l
$KIO_3$—5.06 g/l
Acetic Acid—40.00 g/l
* $BaCO_3$—0.83 g/l
$Ag_2CO_3$—0.42 g/l

* $BaCO_3$ and $Ag_2CO_3$ were added to ensure absence of sulfate and chloride ions from chromic acid in order to show the effects of the additives without catalyzation.

This control of sulfate and chloride ions is for the purposes of testing the additives of this invention only and would not generally be utilized in actual commercial practice.

The mandrels were plated at a current density of 60 a.s.d. for 30 min. at three different temperatures, 40° C., 50° C. and 60° C. For the 60° C. run the current density was raised to 80 a.s.d. for 23 minutes. Each run produced a bright chromium deposit at current efficiencies for each run of about 55%.

EXAMPLE 2

This Example demonstrates the deposition of bright chromium deposits from a chromic acid bath containing a bromine-releasing compound ($KBrO_3$) and acetic acid at 60° C.

A steel mandrel was chromium plated from a chromic acid bath containing the following additives:

$CrO_3$—400 g/l $BrO_3$—16 g/l

Acetic Acid—64 g/l

The mandrel was plated at a current density of about 4 a.s.i. (60 a.s.d.) at 60° C. for about 30 minutes. A bright chromium deposit resulted at a current efficiency of about 31%.

EXAMPLE 3

This example demonstrates the brightness of chromium deposits and the high current efficiencies obtained from a chromium plating bath containing an iodine releasing compound and a propionic acid.

A plating bath was prepared containing the following additives:

$CrO_3$—700 g/l $I^-$—2 g/l (added as KI)

A steel mandrel was plated from this bath (60° C., 60 a.s.d.) as a control and thereafter mandrels were plated from the same bath also containing 4, 8 & 16 g/l of propionic acid.

Table 1 below summarizes the current efficiencies (CE) and appearance of these mandrels.

TABLE 1

| Mandrel | Propionic Acid g/l | CE (%) | Appearance |
|---|---|---|---|
| 1 | 0 | 46.3 | milky |
| 2 | 4 | 47.6 | bright |
| 3 | 8 | 47.2 | bright |
| 4 | 16 | 46.8 | bright but slightly dark |

Table 1 demonstrates that propionic acid raises the current efficiency of plating and vastly improves the appearance of the chromium deposit.

EXAMPLE 4

This Example demonstrates the lack of low current density etching of ferrous basis metals chromium plated from the baths of this invention.

Three chromic acid baths were prepared for plating a ferrous basis metal cathode. The additives contained in these baths are summarized in Table 2 below.

TABLE 2

| BATH C (control) | BATH D | BATH E |
|---|---|---|
| $CrO_3$ (800 g/l | $CrO_3$ 800 g/l | $CrO_3$ 400 g/l |
| $I^-$ 4 g/l | $I^-$ 4 g/l | $I^-$ 4 g/l |
| (added as $KIO_3$) | Succinic Anhydride 30 g/l | Monochloroacetic acid 120 g/l |

The weight loss of the cathode at low current densities 1 a.s.d. to 5 a.s.d. was determined for each bath after 30 minutes. Baths D and E had no weight loss while the control Bath C lost 0.93 g. When the control bath was repeated and chloride was added at 16 g/l as in the Perakh-type baths containing both chloride and iodide, the weight loss increased to 3.64 gm.

EXAMPLE 5

In this Example a number of stable carboxylates were tested in a bath containing chromic acid and either potassium iodide, potassium iodate or sodium iodate as the iodine-releasing compound. Temperatures of the baths varied from 40° C. to 60° C. and current densities varied between 4 to 8 a.s.i. (60 to 120 a.s.d.). The acids included trichloroacetic acid, trifluoroacetic acid and boric acids, sulfoacetic acid, disodium salt, picolinic acid and nicotinic acid. All baths produced bright to semi-bright deposits at current efficiencies greater than about 40%. It was found that boric acid further enhanced the brightness of the deposit formed in a bath containing trifluoroacetic acid.

EXAMPLE 6

This Example demonstrates the improvement in current efficiency and the brightness of a chromium deposit by adding a stable carboxylate to a hexavalent chromium bath containing chromium trioxide and an iodine-releasing compound.

A steel mandrel was plated at 45 a.s.d. from a bath containing the following additives:

$CrO_3$—500 g/l $I^-$—2 g/l (added as $KiO_3$)

The mandrel exhibited a dull gray deposit at a cathode current efficiency of 41%. Acetic acid was added to the bath to a concentration of 10 g/l and a second mandrel was plated at the same current density. The current efficiency increased to 45% and the new deposit was full bright and of commercial character.

We claim:

1. A hexavalent chromium plating bath containing as additives thereto:

(a) an iodine releasing compound, and (b) a stable carboxylate selected from the group consisting of acetic acid, propionic acid, chloroacetic acid, trichloroacetic acid, trifluoroacetic acid, sulfoacetic acid, succinic acid, benzoic acid, nicotinic acid, picolinic acid, salts thereof and anhydrides thereof.

2. The chromium plating bath of claim 1 which further comprises boric acid.

3. The chromium plating bath of claim 1 wherein the concentration of $CrO_3$ is about 800 g/l.

4. The chromium plating bath of claim 1 which further comprises a catalyst ion.

5. The chromium plating bath of claim 1 wherein said iodine releasing compound is selected from the group consisting of iodine, hydroiodic acid and salts thereof, iodic acid and salts thereof, periodic acid and salts thereof, organo iodides and hydrolyzable metal polyiodides.

6. A process for forming bright chromium deposits on a basis metal comprising electrodepositing chromium on said metal at temperatures from about 40° C. to 60° C. from a hexavalent chromium plating bath containing as additives thereto:

(a) an iodine releasing compound; and (b) a stable carboxylate selected from the group consisting of acetic acid, propionic acid chloroacetic acid, trichloroacetic acid, trifluoroacetic acid, sulfoacetic acid, succinic acid, benzoic acid, nicotinic acid, picolinic acid, salts thereof and anhydrides thereof.

7. A hexavalent chromium plating bath containing:

(a) an iodo-oxy ion; and (b) a stable carboxylate selected from the group consisting of a monocarboxylic acid having from 2 to 6 carbon atoms, an anion of said monocarboxylic acid, a dicarboxylic acid having from 4 to 8 carbon atoms and an anion of said dicarboxylic acid.

8. The chromium plating bath of claim 7 wherein said iodo-oxy ion is selected from the group consisting of iodate anion, periodate anion and mixtures thereof.

9. The chromium plating bath of claim 7 wherein said stable carboxylate is acetic acid or propionic acid.

10. The chromium plating bath of claim 7 wherein said stable carboxylate is selected from the group consisting of chloroacetic acid, trichloroacetic acid and trifluoroacetic acid.

11. The chromium plating bath of claim 7 wherein said stable carboxylate is succinic acid.

12. The chromium plating bath of claim 7 wherein said stable carboxylate is benzoic acid.

13. The chromium plating bath of claim 7 wherein said stable carboxylate is sulfoacetic acid.

14. The chromium plating bath of claim 7 wherein said stable carboxylate is nicotinic acid or picolinic acid.

15. The chromium plating bath of claim 7 wherein said bath contains chromic acid added as $CrO_3$, the concentration of said $CrO_3$ being from 200 g/l to 1600 g/l.

16. The chromium plating bath of claim 7 wherein the concentration of $CrO_3$ is about 800 g/l.

17. The chromium plating bath of claim 7 which further comprises a catalyst ion.

* * * * *